United States Patent [19]

Haack

[11] Patent Number: 4,638,511

[45] Date of Patent: Jan. 27, 1987

[54] BOWLING GLOVE

[76] Inventor: Peggy J. Haack, 4913 Elmhurst, Royal Oak, Mich. 48073

[21] Appl. No.: 799,145

[22] Filed: Nov. 18, 1985

[51] Int. Cl.[4] ..... A41D 19/00; A63D 5/00

[52] U.S. Cl. ..... 2/161 A; 2/21; 2/163; 273/54 B

[58] Field of Search ..... 2/161 A, 161 R, 163, 2/21; 273/54 B

[56] References Cited

U.S. PATENT DOCUMENTS

| | | | |
|---|---|---|---|
| 2,388,330 | 11/1945 | Jungmann | 273/54 B X |
| 2,461,970 | 2/1949 | Finegan | 2/21 |
| 2,738,190 | 3/1956 | Tureaud . | |
| 2,827,635 | 3/1958 | Rasmus | 2/21 |
| 2,924,458 | 2/1960 | Barry . | |
| 2,925,605 | 2/1960 | Wheeler | 2/21 |
| 3,031,680 | 5/1962 | Compiano . | |
| 3,038,723 | 6/1962 | Bergendorf . | |
| 3,049,717 | 8/1962 | Meyer . | |
| 3,062,546 | 11/1962 | Horten et al. . | |
| 3,098,654 | 7/1963 | Larsen . | |
| 3,123,832 | 3/1964 | Kubik . | |
| 3,152,337 | 10/1964 | Barry . | |
| 3,203,006 | 8/1965 | Shirey . | |
| 3,229,306 | 1/1966 | Bazar | 273/54 B X |
| 3,362,027 | 6/1966 | Petrov . | |
| 3,593,339 | 7/1971 | Main . | |
| 3,772,706 | 11/1973 | Brigidi . | |
| 4,062,540 | 12/1977 | Calentine | 2/21 X |
| 4,164,043 | 8/1979 | Fujita . | |
| 4,519,097 | 5/1985 | Cappell, Jr. et al. | 2/161 A X |
| 4,524,464 | 6/1985 | Primiano et al. | 2/161 A |

OTHER PUBLICATIONS

"Thumbtector", *Bowling Magazine,* vol. 26, No. 2, Sep. 1959, p. 85.

*Primary Examiner*—Werner H. Schroeder
*Assistant Examiner*—J. L. Olds
*Attorney, Agent, or Firm*—Harness, Dickey & Pierce

[57] ABSTRACT

There is disclosed a bowling glove used for preventing thumb hangups during bowling. The glove is formed as a tube having a tapering side margin which is closed over portions near the smaller end of the margin to form a thumb stall. The thumb stall accommodates the thumb of the wearer and covers the top and sides of the thumb while exposing the inside face of the thumb in gripping contact with the bowling ball. The bowling glove reduces sliding friction between the top of the thumb and the bowling ball when the thumb releases from the bowling ball during delivery.

8 Claims, 3 Drawing Figures

Fig. 1.
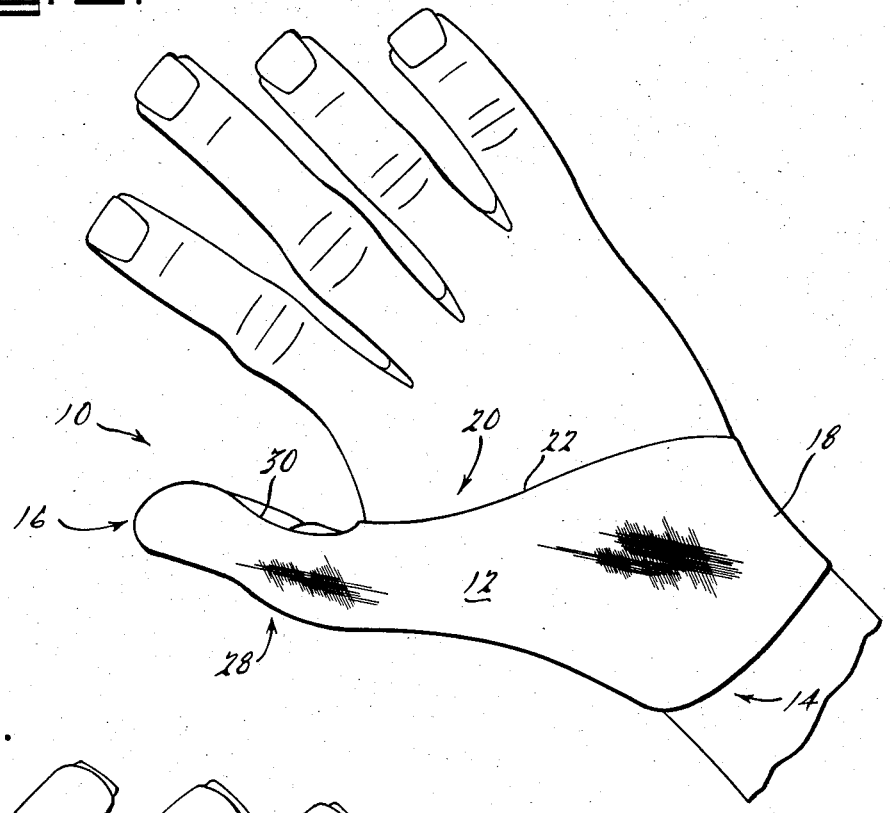
Fig. 2.
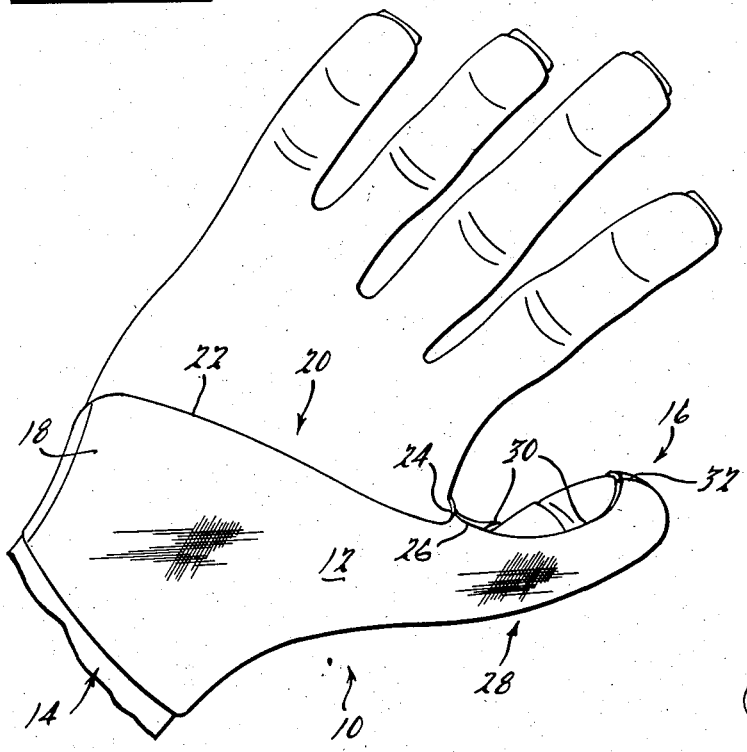
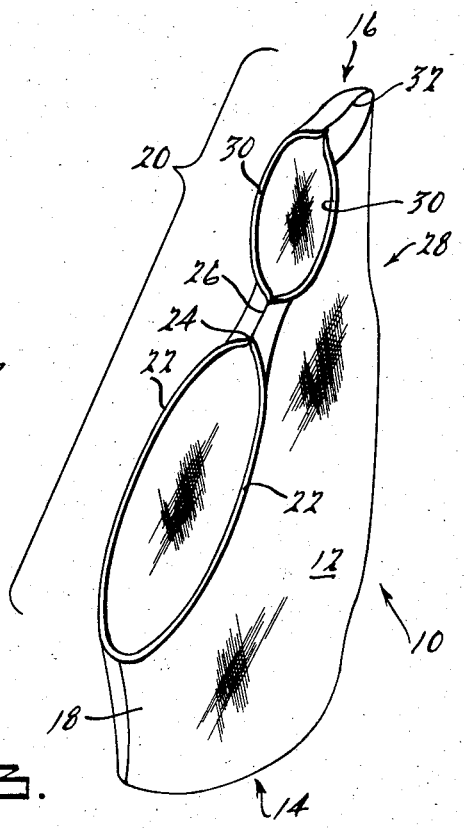
Fig. 3.

BOWLING GLOVE

BACKGROUND AND SUMMARY OF THE INVENTION

The present invention relates to the bowling art and more particularly to a bowling glove which partially encloses the thumb and prevents thumb hangups during bowling.

A common problem experienced by bowlers after extended participation in the game is known as "thumb hangup". When a bowler grips a conventional bowling bowl, the thumb and middle two fingers are inserted into the holes provided in the ball. During delivery of the ball down the alley the thumb is situated above the two fingers and begins to release from the thumb hole while the two fingers continue to impart lift and speed to the ball before they release during the follow-through. As the thumb releases the ball, the top of the thumb, including thumbnail and adjacent knuckle, is oriented upwardly. When the ball is released it travels outwardly and downwardly away from the bowler while the thumb and hand of the bowler are traveling upwardly in an arc-like delivery and follow-through motion. These opposing motions of the ball and thumb during delivery cause sliding contact between the ball and the top of the thumb. During extended bowling the friction which developes from such contact causes the thumb knuckle to swell. Such swelling along with natural body perspiration only enhances the situation as friction between the ball and thumb is thereby increased. This phenomenon, "thumb hangup", severely hinders the smooth delivery and release of the bowling ball that is necessary for accuracy and consistency during the game.

In aggravated cases blisters will form and the top of the thumb and knuckle in particular can become raw and tender, thus markedly affecting the bowler's ability to score well. In extreme cases the bowler is prevented from continuing the game until the swelling and soreness dissipates. Even in cases where the skin on top of the thumb does not form a blister or break open, the constant rubbing between the ball and thumb will evntually cause a callous to form which further enlarges the thumb and contributes to thumb hangups.

Therefore it is desirable to provide a bowler's aid that would prevent the friction-generating contact between the ball and top of the thumb during release of the ball.

It is also desirable to provide a device that can be quickly and easily applied to the bowler's hand and which will interfere as little as possible with the normal functions of the hand.

It is further desirable to provide a bowler's glove in accordance with the foregoing objects which shall be economical, durable, and constructed of a resilient elastic material that permits the thumb some feeling during engagement with the ball.

Additional objects and features of the present invention will become apparent from the subsequent description and appended claims taken in conjunction with the accompanying drawings.

BRIEF DESCRIPTIONS OF THE DRAWINGS

FIG. 1 is a top view showing the bowler's glove of the present invention on the outside of the hand of a wearer.

FIG. 2 is a bottom view showing the bowler's glove on the inside of the hand of a wearer.

FIG. 3 is a perspective view of a bowler's glove embodying the present invention.

DETAILED DESCRIPTION OF THE PREFERRED EMBODIMENTS

Referring now to the drawings a bowling glove in accordance with the present invention is shown in FIG. 1 at 10. Glove 10 comprises a partially closed tapered tube 12 that has an open larger end 14 and a partially closed smaller end 16. Tube 12 is constructed of an elastic, flexible material, such as knitted stretch fabric or the like, that is somewhat porous and will allow the skin it covers to breathe. Tube 12 has a cylindrical band wrist portion 18 at large end 14. Wrist band 18 merges with a side margin 20 which extends in a tapering fashion to smaller end 16 of tube 12.

As shown in FIGS. 1 through 3, a first portion 22 of tapering side margin 20 is open. First portion 22 extends from large end 14 to a thumb junction point 24 located on side margin 20. When glove 10 is applied to the wearer's hand, thumb junction point 24 corresponds generally to the point at which the inner face of the thumb and wrist meet. Adjacent to thumb junction point 24 is a first closed section 26 of side margin 20. First section 26 may be sewn or otherwise fastened and closed to define a thumb stall 28. When glove 10 is applied to the wearer's hand, thumb stall 28 has an overall length substantially equal to the length defined from the end of the wearer's thumb to the wrist/thumb junction point described above.

Intermediate of thumb junction point 24 and smaller end 16 is a second portion 30 of side margin 20 that is open and permits the inner face of the wearer's thumb to be exposed to the bowling ball when the wearer's hand is applied to the ball in a standard grip. Portion 30 is located along tapered side 20 between closed section 26 and smaller end 16 so that the inner face of the thumb corresponding generally to the knuckle adjacent the thumbnail, is uncovered. It has been discovered necessary to have a portion of the thumb's inner face in firm gripping contact with the bowling ball to prevent losing the grip during delivery. The thumb's grip is particularly important during the backswing when the top of the thumb is not in contact with the ball.

Between second portion 30 and smaller end 16 is a second closed section 32 that lies along side margin 20 and may be closed in the same fashion described above.

Glove 10 is applied to the bowler's hand by inserting the hand into larger end 14 and drawing wrist band 18 to a position encircling the wrist while the thumb is inserted into the thumb stall 28 that is formed by first and second closed portions 26 and 32 of tapering side margin 20. As shown in FIG. 2, when glove 10 is applied to the hand, the fingers and palm of the hand are left partially exposed, and only wrist and thumb, except for a gripping portion of the inner face of the thumb, are covered.

Glove 10 thus covers the top and sides of the bowler's thumb that is subjected to thumb hangup during prolonged bowling. Glove 10 permits the bowler's thumb to freely slide out of the bowling ball's thumb hole during release without the heat-building friction that results from sliding contact between the ball and the skin on the top and sides of the thumb. The present invention then significantly reduces the friction generated between the thumb and the ball thereby preventing the swelling which causes thumb hangups and associated wear and tear of the bowler's thumb.

While in the preferred embodiment glove 10 is formed of a single, unitary piece of flexible, elastic, breathable material, glove 10 could be formed of multiple pieces secured together and wrist band 18 could comprise a snap or Velcro loop and hook fastener closing band instead of the continuous band shown and described.

Thus, there is described and shown in the above description, bakcground and drawings a bowling glove which fully and affectively accomplishes the objectives thereof. However, it will be apparent that variations and modifications of the disclosed embodiment may be made without departing from the principles of the invention or the scope of the appended claims.

It is claimed:

1. A bowling glove comprising a wrist band and a thumb stall conected to said wrist band, said thumb stall having an open portion wherein when said glove is applied to a wearer's hand the top of the wearer's thumb is covered and said open portion corresponds to and exposes substantially the entire inner face of said wearer's thumb.

2. A bowling glove as described in claim 1, wherein said glove is formed of a flexible, elastic and breathable material.

3. A bowling glove comprising a tapered tube with a larger end that is open and a smaller end that is closed, said tube having a cylindrical wrist band portion at said large end and a side margin that tapers between said wrist band portion and said smaller end, said tube being open along said side margin between said wrist band portion and a first point located along said side margin, said tube being closed along said side margin between said first point and a second point located along said side margin between said first point and said smaller end, said tube being open along said side margin between said second point and a third point located along said side margin between said second point and said smaller end, said tube being closed between said third point and said smaller end, said tube thereby forming a thumb stall between said first point and said smaller end, whereby when said glove is applied to the wearer's hand said wrist band portion encircles the wearer's wrist and the wearer's thumb is inserted into said stall with the remainder of the wearer's hand extending through the open portion of said side margin between said wrist band portion and said first point, and whereby the top and sides of said thumb is covered by said glove while substantially the entire inner face of said thumb remains exposed.

4. A bowling glove as described in claim 3, wherein said glove is formed of a flexible, elastic, and breathable material.

5. A bowling glove as described in claim 3, wherein said glove is formed of a single, unitary piece of said material.

6. A bowling glove as described in claim 3, wherein the location of said first point along said side margin substantially corresponds to the junction of the said wrist and said inner face of said thumb when said glove is applied to said wearer's hand.

7. A glove as described in claim 6, wherein said second and said third points are located along said side margin to create said open portion of in said side margin that exposes a gripping portion of the inner face of said thumb when said glove is applied to said wearer's hand.

8. A glove as described in claim 7, wherein said gripping portion substantially corresponds to the knuckle which is adjacent to the end of said thumb.

* * * * *